US009283789B2

(12) United States Patent
Ueda

(10) Patent No.: US 9,283,789 B2
(45) **Date of Patent: *Mar. 15, 2016**

(54) SHEET CONVEYING DEVICE AND IMAGE FORMING APPARATUS

(71) Applicant: KYOCERA Document Solutions Inc., Osaka-shi, Osaka (JP)

(72) Inventor: Hiroyuki Ueda, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/495,787

(22) Filed: Sep. 24, 2014

(65) Prior Publication Data

US 2015/0091967 A1 Apr. 2, 2015

(30) Foreign Application Priority Data

Sep. 27, 2013 (JP) ..... 2013-200772
Sep. 27, 2013 (JP) ..... 2013-200773

(51) Int. Cl.

| | |
|---|---|
| ***B41J 29/377*** | (2006.01) |
| ***B65H 5/00*** | (2006.01) |
| ***B41J 11/00*** | (2006.01) |
| ***B41J 13/08*** | (2006.01) |
| ***B41J 15/04*** | (2006.01) |

(Continued)

(52) U.S. Cl.

CPC ..... *B41J 29/377* (2013.01); *B41J 11/007* (2013.01); *B41J 11/0085* (2013.01); *B41J 13/08* (2013.01); *B41J 13/226* (2013.01); *B41J 15/048* (2013.01); *B65H 5/004* (2013.01); *B65H 5/224* (2013.01); *B65H 7/02* (2013.01); *B65H 2406/362* (2013.01); *B65H 2406/3662* (2013.01); *B65H 2511/12* (2013.01); *B65H 2515/342* (2013.01); *B65H 2515/805* (2013.01); *B65H 2801/15* (2013.01)

(58) Field of Classification Search

CPC ..... B41J 11/0085; B41J 11/007; B41J 13/08; B41J 15/048; B41J 13/226

See application file for complete search history.

(56) References Cited

U.S. PATENT DOCUMENTS

| | | | | |
|---|---|---|---|---|
| 9,067,438 | B2 * | 6/2015 | Soda | B41J 11/0085 |
| 2012/0068401 | A1 * | 3/2012 | Kondo | B41J 13/226 271/18.1 |

(Continued)

FOREIGN PATENT DOCUMENTS

| | | | |
|---|---|---|---|
| JP | H04112146 | A | 4/1992 |
| JP | H11217133 | A | 8/1999 |

(Continued)

*Primary Examiner* — Julian Huffman

(74) *Attorney, Agent, or Firm* — Alleman Hall McCoy Russell & Tuttle LLP

(57) ABSTRACT

A sheet conveying device includes a conveyance belt, a conveyance plate, an air intake portion, and a charging portion. The conveyance belt has a plurality of belt openings formed in a previously-set suction attraction region in end portions thereof in a width direction perpendicular to a conveyance direction of a sheet, and conveys the sheet. The conveyance plate has a plurality of platen openings formed therein at positions corresponding to the belt openings in the width direction, and is disposed on a back surface side of the conveyance belt. The air intake portion suctions air through the belt openings and the platen openings from the back surface side of the conveyance plate. The charging portion charges a previously-set electrostatic attraction region in a center portion in the width direction of the conveyance belt.

19 Claims, 10 Drawing Sheets

(51) Int. Cl.

| | |
|---|---|
| ***B41J 13/22*** | (2006.01) |
| ***B65H 5/22*** | (2006.01) |
| ***B65H 7/02*** | (2006.01) |

(56) References Cited

U.S. PATENT DOCUMENTS

| | | | | |
|---|---|---|---|---|
| 2012/0319347 | A1* | 12/2012 | Moore | B65H 5/004 271/12 |
| 2013/0241982 | A1* | 9/2013 | Moore | B41J 25/308 347/8 |
| 2014/0049586 | A1* | 2/2014 | Fletcher | B41J 11/007 347/103 |
| 2014/0210924 | A1* | 7/2014 | Soda | B41J 11/0085 347/105 |

FOREIGN PATENT DOCUMENTS

| | | | |
|---|---|---|---|
| JP | 2002179313 | A | 6/2002 |
| JP | 2006001686 | A | 1/2006 |
| JP | 2008230819 | A | 10/2008 |
| JP | 2008230820 | A | 10/2008 |
| JP | 2008247491 | A | 10/2008 |
| JP | 2010285239 | A | 12/2010 |
| JP | 2011255635 | A | 12/2011 |

* cited by examiner

SHEET CONVEYING DEVICE AND IMAGE FORMING APPARATUS

INCORPORATION BY REFERENCE

This application is based upon and claims the benefit of priority from the corresponding Japanese Patent Application No. 2013-200772 filed on Sep. 27, 2013, and Japanese Patent Application No. 2013-200773 filed on Sep. 27, 2013, the entire contents of which are incorporated herein by reference.

BACKGROUND

The present disclosure relates to a sheet conveying device that conveys a sheet while holding the sheet on a conveyance belt by suction attraction and electrostatic attraction, and relates to an image forming apparatus.

Inkjet recording apparatuses (an example of image forming apparatuses) in which ink is ejected from a recording head onto a sheet to record an image are generally known. As a type of the inkjet recording apparatuses, there is a so-called line-head type inkjet recording apparatus including recording heads for respective colors arranged along a sheet conveyance path. The inkjet recording apparatus of this type incorporates a sheet conveying device that conveys a sheet by means of a conveyance belt while the sheet is facing an ink ejection surface of each recording head, and inks are ejected from the respective recording heads onto the sheet being conveyed.

In addition, a configuration is known in which a sheet is held on a conveyance belt by electrostatic attraction by forming an alternating charge pattern in the conveyance belt while the sheet is held on the conveyance belt by suction attraction by suctioning the sheet through a plurality of belt openings formed in the conveyance belt. In the configuration using suction attraction, a conveyance plate having a plurality of platen openings is provided below the conveyance belt. Then, air is suctioned through the platen openings and the belt openings from the back surface side of the conveyance plate, whereby the sheet is attracted to the conveyance belt.

Moreover, a configuration is known in which suction attraction is used for a center portion in a width direction perpendicular to a conveyance direction of a sheet by a conveyance belt, and electrostatic attraction is used for end portions in the width direction to attract the sheet to the conveyance belt.

SUMMARY

A sheet conveying device according to one aspect of the present disclosure includes a conveyance belt, a conveyance plate, an air intake portion, and a charging portion. The conveyance belt has a plurality of belt openings formed in a previously-set suction attraction region in end portions thereof in a width direction perpendicular to a conveyance direction of a sheet, and conveys the sheet. The conveyance plate has a plurality of platen openings formed therein at positions corresponding to the belt openings in the width direction, and is disposed on a back surface side of the conveyance belt. The air intake portion suctions air through the belt openings and the platen openings from the back surface side of the conveyance plate. The charging portion charges a previously-set electrostatic attraction region in a center portion in the width direction of the conveyance belt.

A sheet conveying device according to another aspect of the present disclosure includes a conveyance belt, a conveyance plate, an air intake portion, and a charging portion. The conveyance belt has a plurality of belt openings formed in previously-set suction attraction regions thereof corresponding to ends of sizes of a plurality of types of sheets in a width direction perpendicular to a conveyance direction of each sheet, and conveys the sheet. The conveyance plate has a plurality of platen openings formed therein at positions corresponding to the belt openings in the width direction, and is disposed on a back surface side of the conveyance belt. The air intake portion suctions air through the belt openings and the platen openings from the back surface side of the conveyance plate. By use of a charging member in contact with a plurality of previously-set electrostatic attraction regions provided so as to avoid the suction attraction regions in the conveyance belt, the charging portion charges the electrostatic attraction regions.

An image forming apparatus according to another aspect of the present disclosure includes the sheet conveying device and an image forming portion. The image forming portion forms an image on the sheet conveyed by the sheet conveying device, by ejecting water based ink.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, embodiments of the present disclosure will be described with reference to the attached drawings for the understanding of the present disclosure. It should be noted that the following embodiments are examples embodying the present disclosure, and by nature, do not limit the technical scope of the present disclosure.

First Embodiment

Figure 1:
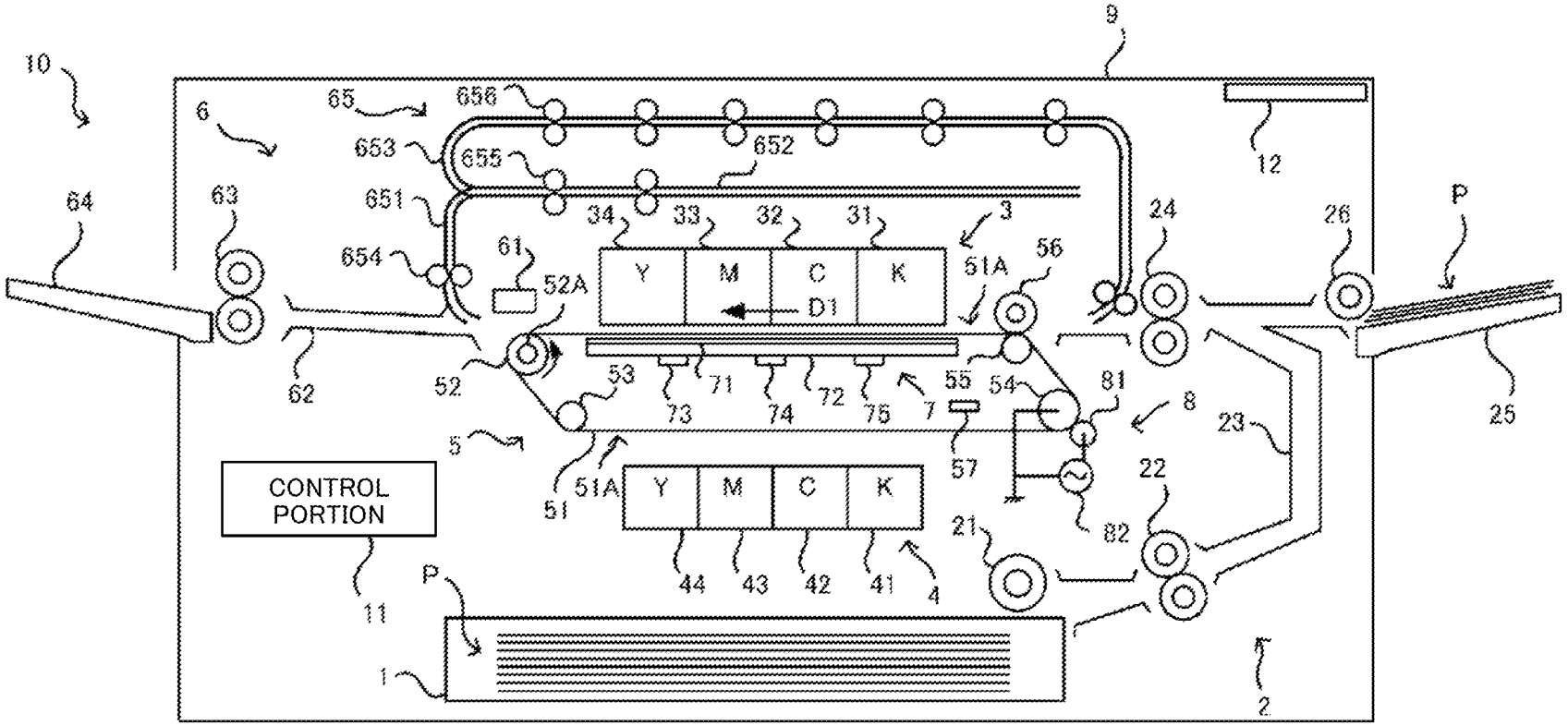
FIG. 1 shows a configuration of an image forming apparatus according to a first embodiment of the present disclosure.

First, a schematic configuration of an image forming apparatus 10 according to a first embodiment of the present disclosure will be described with reference to FIG. 1.

The image forming apparatus 10 includes a sheet feed cassette 1, a sheet feed portion 2, an image forming portion 3, an ink tank portion 4, a sheet conveying portion 5, a sheet discharge portion 6, an air intake portion 7, a charging portion 8, a control portion 11, an operation display portion 12, and a body frame 9. The image forming apparatus 10 is an inkjet printer that forms an image on a sheet by use of water based ink based on printing data (image data) inputted from an information processing apparatus such as a personal computer. The image forming apparatus according to the present disclosure can be applied not only to printers but also to copying machines, facsimile machines, multifunction peripherals, and the like. The device including at least the sheet conveying portion 5, the air intake portion 7, and the charging portion 8 is one example of a sheet conveying device according to the present disclosure.

The operation display portion 12 includes a display portion and an operation portion. The display portion is a liquid crystal display device or an organic EL display which displays various information in accordance with a control instruction from the control portion 11. The operation portion is a touch panel, hard keys, and the like through which various information is inputted to the control portion 11 in accordance with an operation by a user.

The sheet feed cassette 1 holds a plurality of sheets P. Each sheet P is a recording medium such as paper or a film. The image forming apparatus 10 forms an image on the sheet P.

The sheet feed portion 2 includes a pickup roller 21, a conveyance roller pair 22, a conveyance path 23, a registration roller pair 24, a manual sheet feeder 25, and a sheet feed roller 26. The pickup roller 21 picks the sheets P one by one from the sheet feed cassette 1. The conveyance roller pair 22 and the conveyance path 23 convey each sheet P picked by the pickup roller 21 to the registration roller pair 24. The registration roller pair 24 conveys each sheet P to the image forming portion 3 at a predetermined time of conveyance (at a time of start of image drawing). The manual sheet feeder 25 and the sheet feed roller 26 are used to feed the sheets P from outside.

The image forming portion 3 is an inkjet recording portion having a recording head 31 for a color K (black), a recording head 32 for a color C (cyan), a recording head 33 for a color M (magenta), and a recording head 34 for a color Y (yellow). Each of the recording heads 31 to 34 is disposed so as to face a sheet placing surface 51A of a conveyance belt 51 of the sheet conveying portion 5. The recording heads 31 to 34 are each elongated in a width direction D2 perpendicular to a direction D1 of conveyance of the sheets P by the sheet conveying portion 5 and arranged at predetermined intervals along the conveyance direction D1. Lower end portions of the recording heads 31 to 34 are each provided with an ink ejection surface having a number of nozzles (ink outlets) (not shown) from which ink is ejected.

The image forming portion 3 forms an image on each sheet P by ejecting the ink from the ink ejection surfaces of the recording heads 31 to 34 onto the sheet P placed on the sheet placing surface 51A of the conveyance belt 51 and conveyed by the sheet conveying portion 5. That is, the image forming apparatus 10 is a so-called line-head type inkjet recording apparatus. Each ink used in the image forming portion 3 is a water based ink. As an ink ejecting method of the recording heads 31 to 34, there may be employed a piezo method in which ink is ejected using a piezoelectric element or a thermal method in which ink is ejected by generating air bubbles by heating, for example.

The ink tank portion 4 includes an ink tank 41 corresponding to the recording head 31, an ink tank 42 corresponding to the recording head 32, an ink tank 43 corresponding to the recording head 33, and an ink tank 44 corresponding to the recording head 34. The ink tanks 41 to 44 are connected to the recording heads 31 to 34 for the same colors, respectively, with ink tubes not shown, and supply ink of the respective colors to the recording heads 31 to 34.

The sheet conveying portion 5 is disposed below the recording heads 31 to 34. The sheet conveying portion 5 conveys each sheet P fed from the sheet feed portion 2 to the sheet discharge portion 6 while keeping each sheet P facing the ink ejection surfaces of the recording heads 31 to 34. Specifically, the sheet conveying portion 5 includes the conveyance belt 51, a driving roller 52, driven rollers 53, 54, and 55, a pressing roller 56, and a humidity sensor 57. The gap between the conveyance belt 51 and the ink ejection surfaces of the recording heads 31 to 34 is determined so that the distance between each sheet P being conveyed by the conveyance belt 51 and the ink ejection surfaces of the recording heads 31 to 34 is 1 mm or more and 2 mm or less, for example.

The conveyance belt 51 is an endless belt having the sheet placing surface 51A on which each sheet P is placed. The conveyance belt 51 is stretched over the driving roller 52 and the driven rollers 53 to 55 at a predetermined tension. The conveyance belt 51 conveys each sheet P placed on the sheet placing surface 51A in the conveyance direction D1 shown in FIG. 1 by traveling along the conveyance direction D1. The conveyance belt 51 is formed of a dielectric such as urethane rubber, PET (polyethylene terephthalate) resin, ETFE (ethylene-tetrafluoroethylene copolymer) resin, PI (polyimide) resin, or PAI (polyamide imide) resin. For example, the conveyance belt 51 is a multilayer belt including an inner layer having an electric resistance of 5 [log Ω] or more and 7 [log Ω] or less, and an outer layer having an electric resistance of 14 [log Ω] or more and 17 [log Ω] or less provided on the outer circumference of the inner layer.

The driving roller 52 is connected to a rotating shaft of a motor 52A. The conveyance belt 51 travels along the conveyance direction D1 as the driving roller 52 is driven by the motor 52A to rotate counterclockwise. Meanwhile, the driven rollers 53 to 55 rotate with the drive force generated by the driving of the driving roller 52 and transmitted via the conveyance belt 51.

The driven roller 54 is a metal roller or the like having electrical conductivity and elongated in the width direction D2, and is connected to the same ground as the charging portion 8. Thereby, the driven roller 54 acts as an electrode in charging of the conveyance belt 51 by the charging portion 8.

The pressing roller 56 is provided in a sheet feed position where each sheet P is fed from the sheet feed portion 2 to the sheet conveying portion 5. The pressing roller 56 is disposed in a position opposed to the driven roller 55, and the conveyance belt 51 is held between the driven roller 55 and the pressing roller 56. The pressing roller 56 presses each sheet P fed from the sheet feed portion 2 into close contact with the conveyance belt 51.

The humidity sensor 57 is a humidity detecting portion which detects humidity in the image forming apparatus 10. The humidity detected by the humidity sensor 57 is inputted to the control portion 11.

The sheet discharge portion 6 is provided on a downstream side of the image forming portion 3 in the conveyance direction D1 of the sheet conveying portion 5. The sheet discharge portion 6 includes a drying device 61, a conveyance path 62, a sheet discharging roller pair 63, a sheet discharge tray 64, a double-sided printing mechanism 65, and the like. The drying device 61 dries the ink adhering to each sheet P by sending air to the sheet P. The conveyance destination of each sheet P on which an image has been formed in the image forming portion 3 and which has been dried in the drying device 61 is switched to either the conveyance path 62 or the double-sided printing mechanism 65 by a switching portion (not shown) controllable by the control portion 11. Each sheet P conveyed into the conveyance path 62 is discharged to the sheet discharge tray 64 by the sheet discharging roller pair 63.

Meanwhile, the double-sided printing mechanism 65 reverses the front and back surfaces of each sheet P on which an image has been formed by the image forming portion 3, and conveys the sheet P again to the image forming portion 3. Specifically, the double-sided printing mechanism 65 includes conveyance paths 651 to 653 and conveyance roller pairs 654 to 656 arranged on the conveyance paths 651 to 653. In the conveyance path 651, the sheet P is conveyed toward the conveyance path 652 by the conveyance roller pair 654. The conveyance path 652 is a path for reversing the front and back surfaces of the sheet P. With respect to the conveyance path 652, the sheet P is received in the conveyance path 652 by means of the conveyance roller pair 655, and then, by the reverse drive of the conveyance roller pair 655, the sheet P is conveyed from the rear end thereof into the conveyance path 653. The conveyance path 652 is provided with a switching portion (not shown) which is controlled by the control portion 11 and which switches the connection destination of the conveyance path 652 to either the conveyance path 651 or the conveyance path 653. The conveyance path 653 is a path for conveying the sheet P to the image forming portion 3 again. In the conveyance path 653, the sheet P is conveyed by the conveyance roller pair 656 toward the pressing roller 56 on an upstream side of the image forming portion 3. Accordingly, in the image forming portion 3, after an image has been formed on the front surface of the sheet P, an image can be formed on the back surface of the sheet P. That is, the image forming apparatus 10 has a double-sided printing function of forming images on the front and back surfaces of the sheet P.

The air intake portion 7 is disposed below the recording heads 31 to 34 and inside the conveyance belt 51 having a loop shape. The air intake portion 7 suctions air from the back surface side of the conveyance belt 51, thereby attracting the sheet P to the conveyance belt 51. A configuration of the air intake portion 7 will be described later in detail.

The charging portion 8 is disposed on an upstream side of the pressing roller 56 in the conveyance direction D1 of the conveyance belt 51, that is, on an upstream side with respect to the sheet feed position of each sheet P from the sheet feed portion 2. The charging portion 8 includes a charging member 81 and a power supply device 82, and charges the sheet placing surface 51A of the conveyance belt 51. The charging member 81 is electrically connected to the power supply device 82.

The charging member 81 is a roller member which is disposed in a position opposed to the driven roller 54 via the conveyance belt 51, and which is driven to rotate clockwise by the travelling of the conveyance belt 51 in the conveyance direction D1. The charging member 81 is a roller member having electrical conductivity. The electric resistance thereof is 3 [log Ω] or more and 9 [log Ω] or less, for example. The charging member 81 is formed from one or a mixture of a plurality of resin materials such as urethane based resin, thermoplastic elastomer, epichlorohydrin rubber, ethylene-propylene-diene copolymer rubber (EPDM), silicone based rubber, acrylonitrile-butadiene copolymer rubber, and polynorbornene rubber, for example. The charging member 81 may be a blade. In another embodiment, the charging portion 8 may include two or more of the charging members 81.

The power supply device 82 is a constant-voltage power source that applies a predetermined constant voltage to the charging member 81. Specifically, the power supply device 82 applies to the charging member 81 an alternating voltage of 5 k [Vp−p] that alternates between +2.5 [kV] and −2.5 [kV] with a previously-set alternating period T1 [s]. For example, the power supply device 82 switches the polarity of the constant voltage (2.5 kV) outputted from an output terminal connected to the charging member 81 with the alternating period T1 [s]. For example, the alternating period T1 is 1/100 [s] or longer and 1/10 [s] or shorter, and the frequency of the alternating voltage to be outputted from the power supply device 82 is 10 [Hz] or higher and 100 [Hz] or lower. When the power supply device 82 applies the alternating voltage to the charging member 81, a band-shaped pattern of charges alternating between positive and negative is formed on the sheet placing surface 51A of the conveyance belt 51. Thus, each sheet P fed from the sheet feed portion 2 to the conveyance belt 51 is conveyed while being held on the conveyance belt 51 by electrostatic attraction. It should be noted that the voltage applied by the charging member 81 to the conveyance belt 51 is not limited to the alternating voltage as described above, but may be any DC voltage or AC voltage.

Lifting in a sheet P conveyed by the conveyance belt 51 tends to occur in corner portions of the sheet P. On the other hand, in a high humidity environment or after an image has been formed on a sheet P with ink, electric resistance of the sheet P is reduced, resulting in lower charging efficiency, and thus, attraction force by electrostatic attraction may be reduced. Therefore, in a configuration in which end portions in the width direction D2 of the sheet P are attracted by electrostatic attraction, lifting in corner portions of the sheet P may not be sufficiently prevented from occurring. In a configuration in which suction attraction is performed in the entirety of the conveyance belt 51, the force attracting the conveyance belt 51 to a conveyance plate 71 described later greatly changes in accordance with the presence/absence of a sheet P placed on the conveyance belt 51 or the size of the sheet P. This may cause influence on the drive of the conveyance belt 51. In contrast, in the image forming apparatus 10, as described below, while preventing influence on the drive of the conveyance belt 51, lifting in corner portions of the sheet P can be prevented from occurring.

Figure 2:
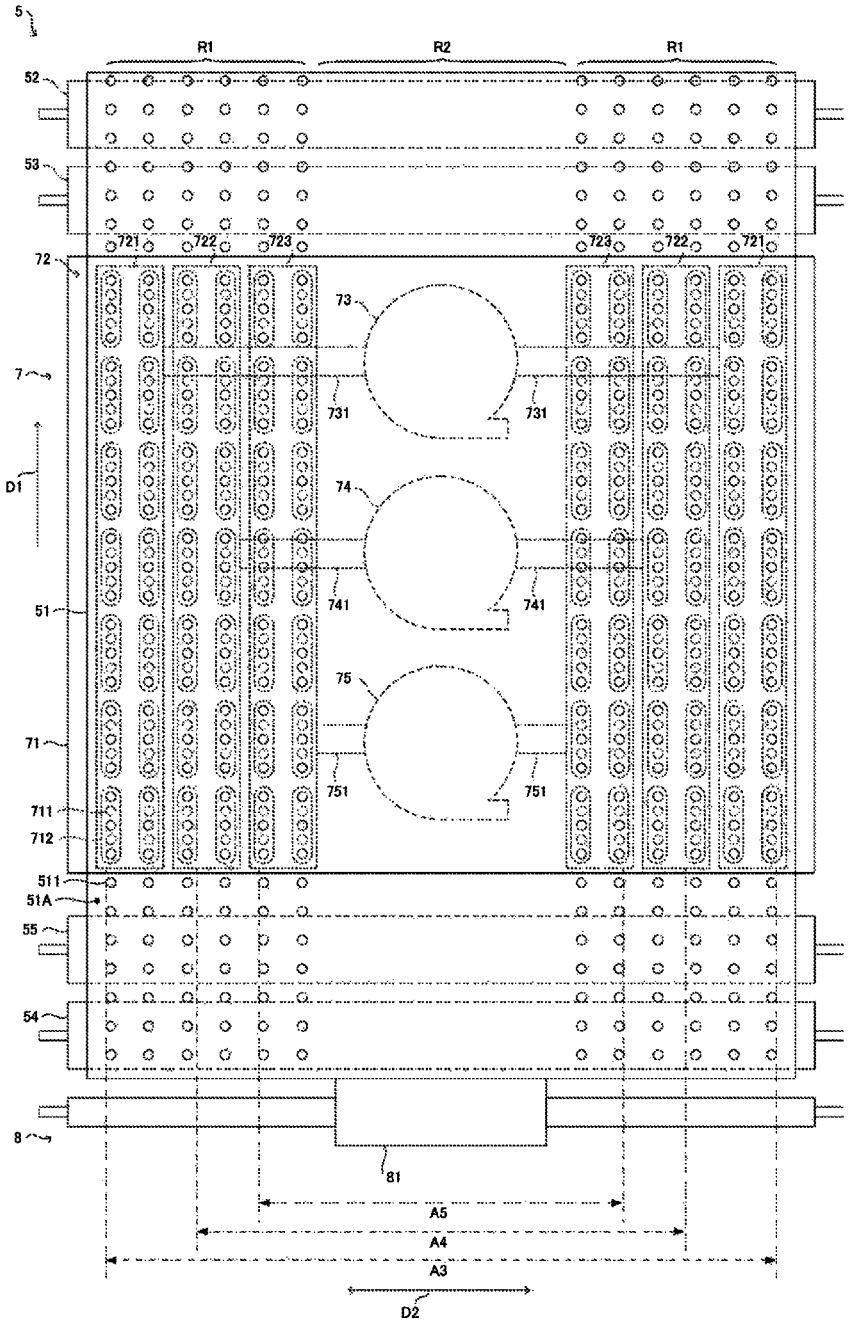
FIG. 2 shows a conveyance belt provided in the image forming apparatus according to the first embodiment of the present disclosure, viewed from above.

Next, with reference to FIG. 2, details of the air intake portion 7 and the charging portion 8 will be described. FIG. 2 is a schematic diagram of the conveyance belt 51 viewed from above.

As shown in FIG. 2, the conveyance belt 51 has a plurality of belt openings 511 penetrating the sheet placing surface 51A. The shape of each belt opening 511 is circular, elliptical, rectangular, or the like. The belt openings 511 are formed in a previously-set suction attraction region R1 in end portions of the conveyance belt 51 in the width direction D2 perpendicular to the conveyance direction D1 of the sheet P, at predetermined intervals in the conveyance direction D1 and the width direction D2. For example, the suction attraction region R1 is a region, in the end portions in the width direction D2 of the conveyance belt 51, that includes ends of the maximum size (e.g., A3) of the sheet P and ends of the minimum size (e.g., A5) of the sheet P that are usable in the image forming apparatus 10. The belt openings 511 may be arranged in the conveyance belt 51 in a staggered manner.

The air intake portion 7 includes the conveyance plate 71, an air intake duct 72, and air intake fans 73 to 75. The conveyance plate 71 is a plate member facing the ink ejection surfaces of the recording heads 31 to 34 and disposed on the back surface side of the conveyance belt 51. The conveyance plate 71 has a plurality of platen openings 711 penetrating the front and back surfaces and a plurality of grooves 712 formed on the front surface. The platen openings 711 are formed at predetermined intervals along the conveyance direction D1 at positions corresponding to the belt openings 511 in the width direction D2. The shape of the platen opening 711 is circular, elliptical, rectangular, or the like. Each groove 712 is a long groove formed so as to extend in a direction along the conveyance direction D1, and includes at least one platen opening 711. Accordingly, the force attracting the sheet P by the air intake portion 7 acts not only in the regions where the platen openings 711 are formed but also in regions where the grooves 712 are formed.

The air intake duct 72 is disposed beneath the conveyance plate 71 and connected to a back surface of the conveyance plate 71. The air intake duct 72 includes a plurality of air intake ducts 721 to 723 which are provided so as to correspond to the sizes of sheets P to be conveyed by the conveyance belt 51, and which form air flow paths below the platen openings 711 of the conveyance plate 71. Specifically, the air intake duct 721 is a pair of ducts corresponding to regions including positions of both ends of a previously-set first size in the width direction D2. The air intake duct 723 is a pair of ducts corresponding to regions including positions of both ends of a previously-set third size in the width direction D2. The air intake duct 722 is a pair of ducts corresponding to regions including positions of both ends of a previously-set second size in the width direction D2.

For example, the first size corresponding to the air intake duct 721 is the maximum size usable in the image forming apparatus 10, and may be "A3", for example. The third size corresponding to the air intake duct 723 is the minimum size usable in the image forming apparatus 10, and may be "A5", for example. The second size corresponding to the air intake duct 722 is an intermediate size between the maximum size and the minimum size, and may be "A4", for example. Each of the air intake ducts 721 to 723 may correspond to a plurality of sizes. For example, the air intake duct 721 may correspond to "A3" and "B4", the air intake duct 722 may correspond to "A4" and "B5", and the air intake duct 723 may correspond to "A5" and "A6".

The air intake fans 73 to 75 are each a centrifugal fan called sirrocco fan, for example. The air intake portion 7 suctions air through the belt openings 511 and the platen openings 711 from the back surface side of the conveyance plate 71, thereby attracting each sheet P to the conveyance belt 51. The turning on/off the drive and the rotational speed of each of the air intake fans 73 to 75 can be individually controlled by the control portion 11. The air intake fans 73 to 75 each may be an axial fan such as a propeller fan.

The air intake fans 73 to 75 are provided so as to correspond to the air intake ducts 721 to 723, respectively. The air intake fan 73 and the air intake duct 721 are connected to each other with a connection duct 731. Accordingly, an air flow path is formed that extends from the platen openings 711 in the conveyance plate 71 formed at positions correspond to the air intake duct 721, via the air intake duct 721 and the connection duct 731, to the air intake fan 73.

Similarly, the air intake fan 74 and the air intake duct 722 are connected to each other with a connection duct 741. Accordingly, an air flow path is formed that extends from the platen openings 711 in the conveyance plate 71 formed at positions corresponding to the air intake duct 722, via the air intake duct 722 and the connection duct 741, to the air intake fan 74. Moreover, the air intake fan 75 and the air intake duct 723 are connected to each other with a connection duct 751. Accordingly, an air flow path is formed that extends from the platen openings 711 in the conveyance plate 71 formed at positions corresponding to the air intake duct 723, via the air intake duct 723 and the connection duct 751, to the air intake fan 75.

Therefore, in the air intake portion 7, by switching turning on/off the drive of each of the air intake fans 73 to 75, it is possible to individually switch the turning on/off suction of air at each region corresponding to the air intake duct 721 to 723 in the suction attraction region R1.

It should be noted that the image forming apparatus 10 may include one air intake fan instead of the air intake fans 73 to 75, and shutters which open and close air flow paths extending from the air intake fan to the respective air intake ducts 721 to 723. Alternatively, the image forming apparatus 10 may include six air intake fans corresponding to the six ducts of the air intake ducts provided in the suction attraction region R1.

On the other hand, the charging member 81 of the charging portion 8 has a width corresponding to a previously-set electrostatic attraction region R2 in a center portion in the width direction D2. Accordingly, the charging portion 8 can charge the electrostatic attraction region R2 in the center portion in the width direction D2 of the conveyance belt 51, by means of the charging member 81. That is, the charging portion 8 does not apply voltage to the suction attraction region R1 of the conveyance belt 51, the suction attraction region R1 of the conveyance belt 51 is not charged. Therefore, discharge that may occur in the belt openings 511 in a configuration using both electrostatic attraction and suction attraction to attract each sheet P to the conveyance belt 51 and convey the sheet P is prevented, and deterioration of the conveyance belt 51, the charging member 81, the driven roller 54, and the like is prevented.

Thus, in the image forming apparatus 10, end portions in the width direction D2 of each sheet P can be attracted to the conveyance belt 51 by suction attraction by the air intake portion 7, and thus, even in a high humidity environment or even after an image has been formed on the sheet P, high flatness of the sheet P can be maintained. Accordingly, the distance between the ink ejection surfaces of the recording heads 31 to 34 and each sheet P being conveyed by the conveyance belt 51 is kept constant. Thereby, contact between the ink ejection surfaces and each sheet P is prevented. Moreover, compared with a configuration in which suction attraction is performed in the entirety of the conveyance belt 51, change in the force attracting the conveyance belt 51 to the conveyance plate 71 in accordance with the presence/absence of a sheet P placed on the conveyance belt 51 or the size of the sheet P is reduced. Accordingly, influence on the drive of the conveyance belt 51 is prevented.

Subsequently, a system configuration of the image forming apparatus 10 will be described with reference to FIG. 3.

Figure 3:
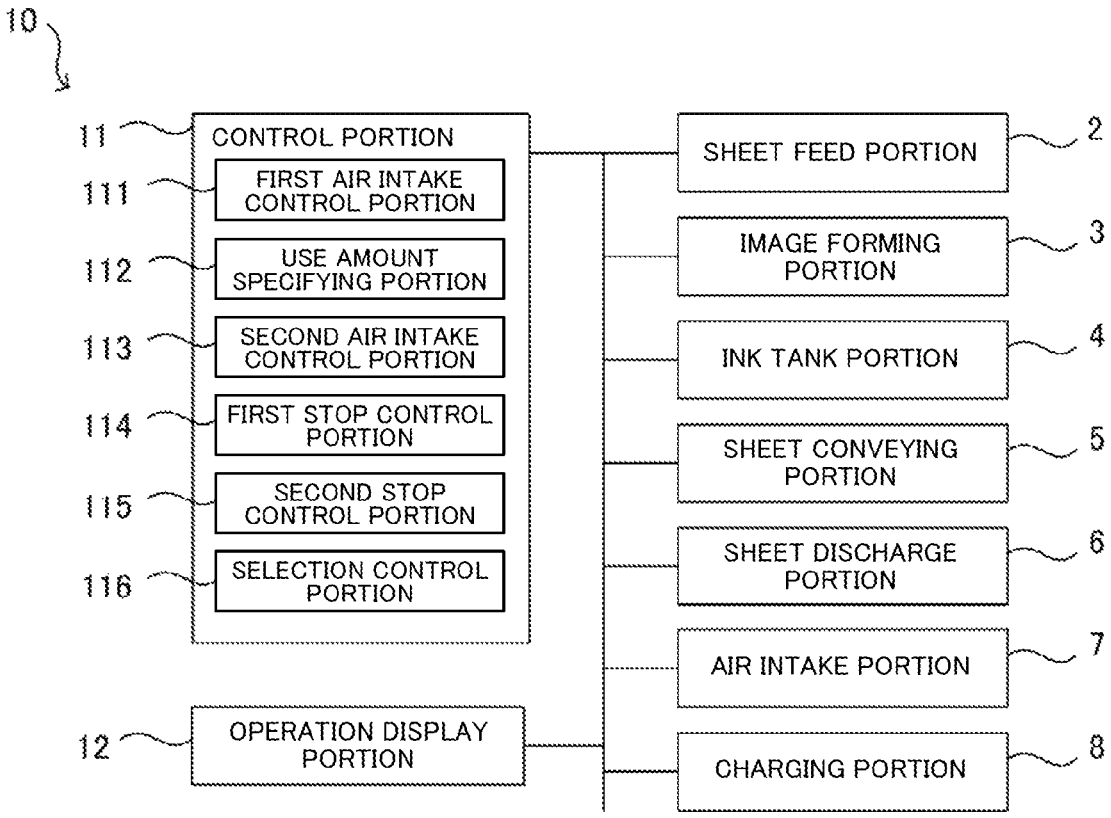
FIG. 3 is a block diagram showing a system configuration of the image forming apparatus according to the first embodiment of the present disclosure.

As shown in FIG. 3, the control portion 11 is connected to the sheet feed portion 2, the image forming portion 3, the ink tank portion 4, the sheet conveying portion 5, the sheet discharge portion 6, the air intake portion 7, the charging portion 8, and the operation display portion 12.

The control portion 11 includes control devices such as a CPU, a ROM, a RAM, and an EEPROM. The CPU is a processor that executes various calculation processes. The control portion 11 may include a plurality of control main bodies (processors). The ROM is a non-volatile storage portion in which information such as control programs for causing the CPU to execute various processes is previously stored. The CPU comprehensively controls the image forming apparatus 10 by executing various processes in accordance with various control programs previously stored in the ROM. The RAM is a volatile storage portion, and the EEPROM is a non-volatile storage portion. The RAM and the EEPROM are used as temporary storage memories (working areas) for various processes executed by the CPU.

The control portion 11 includes a first air intake control portion 111, a use amount specifying portion 112, a second air intake control portion 113, a first stop control portion 114, a second stop control portion 115, and a selection control portion 116. Specifically, the control portion 11 executes, by use of the CPU, the control programs stored in the ROM, thereby functioning as the first air intake control portion 111, the use amount specifying portion 112, the second air intake control portion 113, the first stop control portion 114, the second stop control portion 115, and the selection control portion 116. In a case where the control portion 11 is an electronic circuit such as ASIC, the first air intake control portion 111, the use amount specifying portion 112, the second air intake control portion 113, the first stop control portion 114, the second stop control portion 115, and the selection control portion 116 are circuit modules included in the control portion 11.

The first air intake control portion 111 controls operation of the air intake portion 7 during front surface printing of each sheet P in the image forming apparatus 10. Specifically, the first air intake control portion 111 controls the air intake portion 7 such that the higher the humidity detected by the humidity sensor 57 is, the higher the air suction force becomes. In the present embodiment, an exemplary case will be described in which the first air intake control portion 111 switches the suction force between "high" and "low" in accordance with whether the humidity is higher than or equal to a previously-set first threshold. It should be noted that the first air intake control portion 111 can change the air suction force by the air intake portion 7, by changing the rotational speed of each of the air intake fans 73 to 75.

The use amount specifying portion 112 specifies a use amount of ink to be ejected to the front surface of the sheet P by the image forming portion 3 in the image forming apparatus 10. The ink use amount is used as an index value for a water content in the sheet P after an image is formed by the image forming portion 3. For example, it is conceivable that the use amount specifying portion 112 derives a coverage rate or an ink amount rate based on image data inputted to the image forming apparatus 10, thereby specifying the ink use amount based on the coverage rate or the ink amount rate. The coverage rate is a value indicating the percentage of the printed area in the printable region of each sheet P. The ink amount rate is a value indicating the percentage of the amount of ink to be ejected to the sheet P by each of the recording heads 31 to 34 relative to the maximum value.

The second air intake control portion 113 controls operation of the air intake portion 7 when the sheet P is conveyed again to the image forming portion 3 by the double-sided printing mechanism 65, i.e. during back surface printing of the sheet P. Specifically, the second air intake control portion 113 controls the air intake portion 7 such that the larger the ink use amount specified by the use amount specifying portion 112 is, the higher the air suction force becomes, when the sheet P is conveyed again to the image forming portion 3 by the double-sided printing mechanism 65. In the present embodiment, an exemplary case will be described in which the second air intake control portion 113 switches the suction force during back surface printing of the sheet P between "high" and "low" in accordance with whether the ink use amount is greater than or equal to a previously-set second threshold.

The first stop control portion 114 stops suction of air by the air intake portion 7 when the humidity detected by the humidity sensor 57 is less than a previously-set third threshold, or when the ink use amount specified by the use amount specifying portion 112 is less than a previously-set fourth threshold.

The second stop control portion 115 stops charging by the charging portion 8, when the humidity detected by the humidity sensor 57 is higher than or equal to a previously-set fifth threshold, or when the ink use amount specified by the use amount specifying portion 112 is higher than or equal a previously-set sixth threshold.

The selection control portion 116 selects one or a plurality of air intake ducts to be used in suction of air by the air intake portion 7, from among the air intake ducts 721 to 723, in accordance with the size of the sheet P, the humidity, the ink use amount, and the like.

[Conveyance Control Process]

Figure 4:
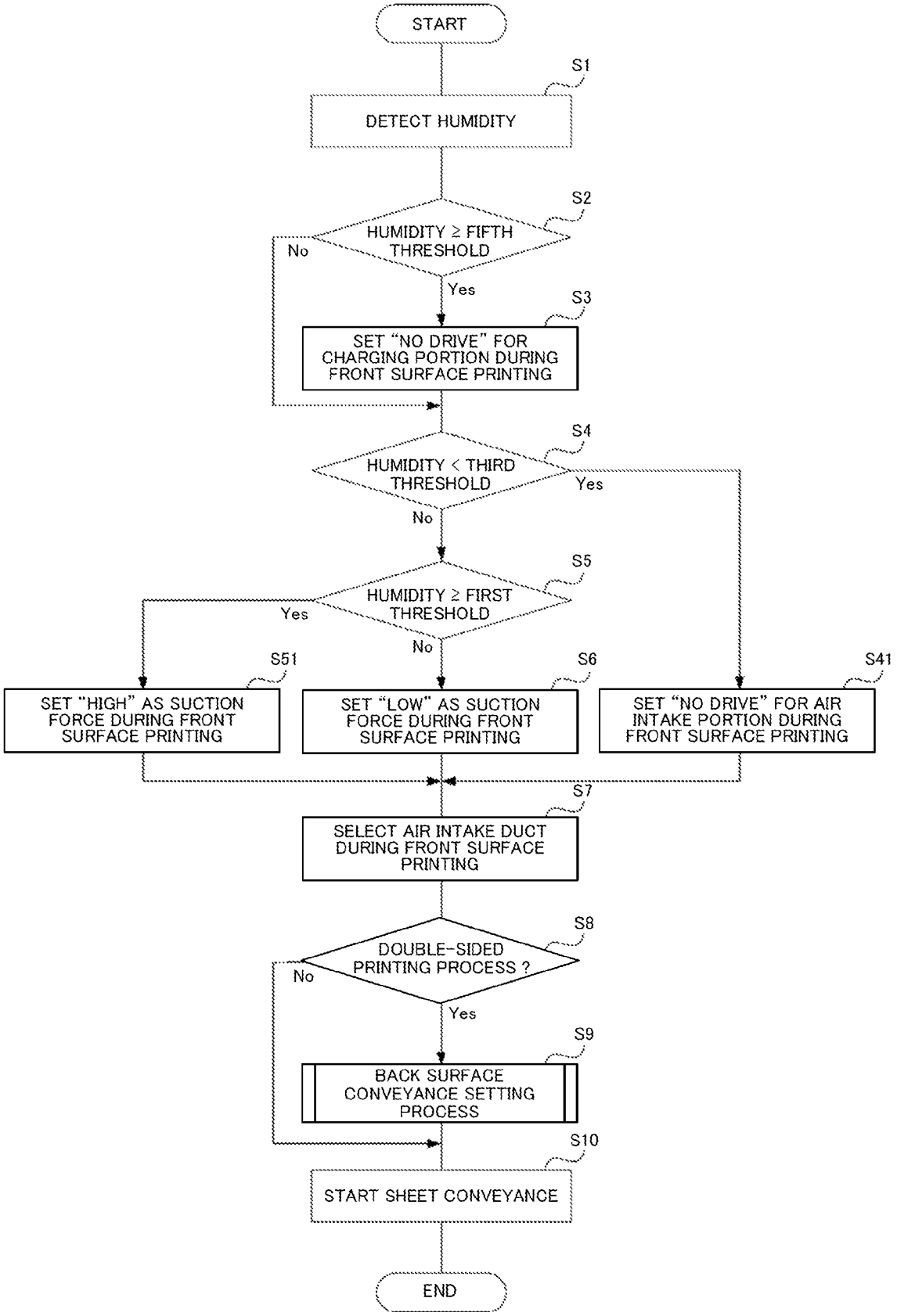
FIG. 4 is a flow chart showing a conveyance control process executed by the image forming apparatus according to the first embodiment of the present disclosure.
Figure 5:
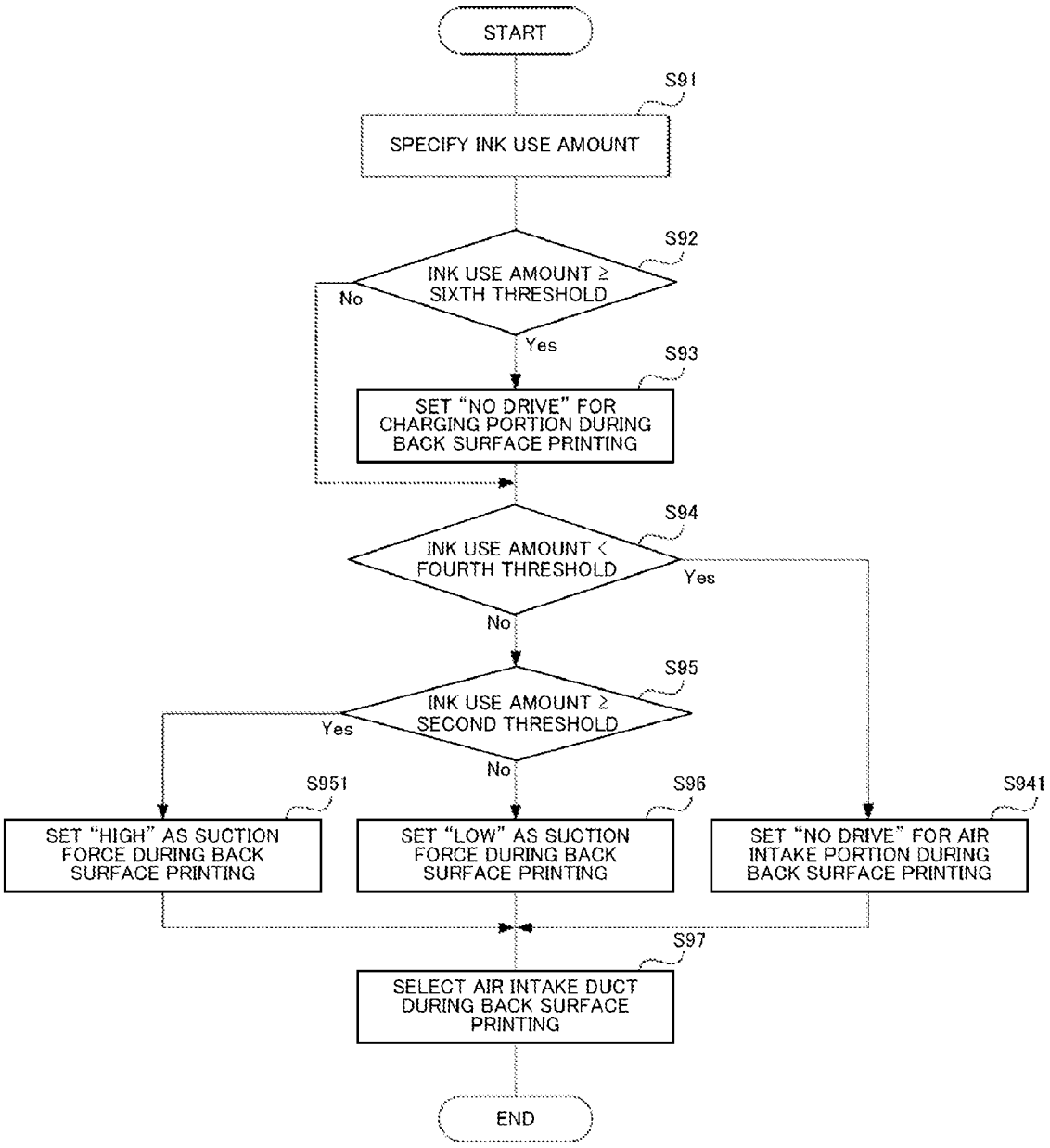
FIG. 5 is a flow chart showing a conveyance control process executed by the image forming apparatus according to the first embodiment of the present disclosure.

Hereinafter, one example of the procedure of a conveyance control process executed by the control portion 11 will be described with reference to the flow charts shown in FIG. 4 and FIG. 5. Process steps executed by the control portion 11 will be referred to as steps S1, S2, and the like. This conveyance control process is executed by the control portion 11 when an image forming process is executed in which an image is formed on each sheet P by use of the image forming portion 3 in the image forming apparatus 10.

<Step S1>

First, in step S1, the control portion 11 detects humidity in the image forming apparatus 10 by use of the humidity sensor 57.

<Step S2>

In step S2, the second stop control portion 115 of the control portion 11 determines whether the humidity detected in step S1 is higher than or equal to the previously-set fifth threshold. The fifth threshold is a value previously set in order to determine whether the attraction force by electrostatic attraction is sufficiently low. For example, the fifth threshold may be a previously-set value in a range of 50% or higher and 80% or lower. When determining that the humidity is higher than or equal to the fifth threshold (Yes in S2), the control portion 11 shifts the process to step S3. On the other hand, when determining that the humidity is less than the fifth threshold (No in S2), the control portion 11 shifts the process to step S4.

<Step S3>

In step S3, the second stop control portion 115 of the control portion 11 sets "no drive" with regard to turning on/off the drive of the charging portion 8 during front surface printing in the image forming process. Accordingly, during front surface printing in the image forming process, charging by the charging portion 8 is stopped and electrostatic attraction is not performed. Thus, in the image forming apparatus 10, in a case where the attraction force by electrostatic attraction is low because the humidity is sufficiently high, the drive of the charging portion 8 is stopped, whereby power saving is achieved.

<Step S4>

In step S4, the first stop control portion 114 of the control portion 11 determines whether the humidity detected in step S1 is less than the previously-set third threshold. The third threshold is a value previously set in order to determine whether the attraction force by electrostatic attraction is sufficiently high. For example, the third threshold may be a previously-set value in a range of 10% or higher and 50% or lower. When determining that the humidity is less than the third threshold (Yes in S4), the control portion 11 shifts the process to step S41. On the other hand, when determining that the humidity is higher than or equal to the third threshold (No in S4), the control portion 11 shifts the process to step S5.

<Step S41>

In step S41, the first stop control portion 114 of the control portion 11 sets "no drive" with regard to turning on/off the drive of the air intake portion 7 during front surface printing in the image forming process. Accordingly, suction of air by the air intake portion 7 is stopped during front surface printing in the image forming process, and suction attraction is not performed. Thus, in the image forming apparatus 10, in a case where the humidity is sufficiently low and the attraction force by electrostatic attraction is high, the drive of the air intake portion 7 is stopped, whereby power saving is achieved.

<Step S5>

In step S5, the first air intake control portion 111 of the control portion 11 determines whether the humidity detected in step S1 is higher than or equal to the previously-set first threshold. The first threshold is a value previously set in order to determine whether the attraction force by electrostatic attraction is low. For example, the first threshold may be a previously-set value in a range of 50% or higher and 80% or lower. When determining that the humidity is higher than or equal to the first threshold (Yes in S5), the control portion 11 shifts the process to step S51. On the other hand, when determining that the humidity is less than the first threshold (No in S5), the control portion 11 shifts the process to step S6.

<Step S51>

In step S51, the first air intake control portion 111 of the control portion 11 sets previously-set "high" as the suction force by the air intake portion 7 during front surface printing in the image forming process. That is, in a case where the humidity is high, the suction force by the air intake portion 7 is set high, whereby insufficient attraction force by electrostatic attraction due to reduced charging efficiency of the sheet P by the charging portion 8 is compensated.

<Step S6>

In step S6, the first air intake control portion 111 of the control portion 11 sets previously-set "low" which is lower than the "high" set in step S51, as the suction force by the air intake portion 7 during front surface printing in the image forming process. That is, in a case where the humidity is low, charging efficiency of the sheet P by the charging portion 8 is high and the attraction force by electrostatic attraction is high. Thus, by setting the suction force by the air intake portion 7 to be low, power consumption by the air intake portion 7 is suppressed.

<Step S7>

In step S7, in accordance with the size of the sheet P and the humidity, the selection control portion 116 of the control portion 11 selects one or a plurality of air intake ducts from among the air intake ducts 721 to 723, as air intake ducts to be used during front surface printing of the sheet P. In the present embodiment, the selection from among the air intake ducts 721 to 723 is equivalent to selection from among the air intake fans 73 to 75. For example, the control portion 11 selects an air intake duct in the following procedure.

First, the control portion 11 selects an air intake duct present at the position of the ends in the width direction D2 of the size of the sheet P, from among the air intake ducts 721 to 723. For example, in a case where the size of the sheet P is "A3", the air intake duct 721 is selected. In a case where the size of the sheet P is "A4", the air intake duct 722 is selected. In a case where the size of the sheet P is "A5", the air intake duct 723 is selected.

Accordingly, from among the air intake ducts 721 to 723, the air intake duct present at the ends of the size of the sheet P is selected, to be used during sheet conveyance. Therefore, lifting in end portions of the sheet P, especially in corner portions, is prevented from occurring.

Then, in accordance with the humidity, the control portion 11 determines whether to use one or a plurality of air intake ducts present inside relative to the air intake duct selected according to the size of the sheet P, among the air intake ducts 721 to 723. For example, in a case where the air intake duct 721 has been selected in accordance with the size of the sheet P and the humidity is higher than or equal to a previously-set first humidity, the control portion 11 determines to use the air intake duct 722 and the air intake duct 723 along with the air intake duct 721. In a case where the air intake duct 721 has been selected in accordance with the size of the sheet P and the humidity is less than the first humidity and higher than or equal to a previously-set second humidity, the control portion 11 determines to use the air intake duct 722 along with the air intake duct 721. Further, in a case where the air intake duct 721 has been selected in accordance with the size of the sheet P and the humidity is less than the second humidity, the control portion 11 determines not to use the air intake duct 722 and the air intake duct 723.

In this manner, in a case where the humidity is high and the attraction force by electrostatic attraction is low, along with an air intake duct selected in accordance with the size of the sheet P, one or a plurality of air intake ducts present inside relative to the air intake duct are used. Thus, insufficient attraction force by electrostatic attraction is compensated with suction attraction by the air intake portion 7. Moreover, in a case where the humidity is low and the attraction force by electrostatic attraction is high, unnecessary drive of the air intake fans 73 to 75 is prevented. Therefore, power consumption by the air intake portion 7 is suppressed. It should be noted that in a case where "no drive" has been set for the air intake portion 7 in step S41, the control portion 11 may skip step S7.

<Step S8>

Next, in step S8, the control portion 11 determines whether the image forming process is double-sided printing process in which the double-sided printing mechanism 65 is used. When determining that the image forming process is the double-sided printing process (Yes in S8), the control portion 11 shifts the process to step S9, and executes a back surface conveyance setting process described later (see FIG. 5). On the other hand, when determining that the image forming process is not the double-sided printing process (No in S8), the control portion 11 shifts the process to step S10.

<Step S9>

Now, the back surface conveyance setting process will be described with reference to FIG. 5.

<Step S91>

First, in step S91, the use amount specifying portion 112 of the control portion 11 specifies an ink use amount during front surface printing of the sheet P in the image forming process. In the image forming apparatus 10, when ink is ejected onto the sheet P and the water content in the sheet P increases, the electric resistance of the sheet P is reduced, resulting in reduced charging efficiency of the sheet P. Step S91 is a process for obtaining the ink use amount during front surface printing of the sheet P, as an index for determining whether the charging efficiency of the sheet P during back surface printing of the sheet P is high or low.

In particular, during front surface printing of the sheet P, in a case where much ink is ejected onto end portions in the width direction D2 at the leading end or the rear end in the conveyance direction D1 of the sheet P, lifting tends to occur in corner portions of the sheet P during back surface printing of the sheet P. Therefore, it is conceivable that the ink use amount specified in step S91 is not the total amount of ink to be ejected to the entirety of the sheet P, but is an ink use amount in a previously-set partial specific region in the sheet P. The specific region includes a previously-set range from the leading end or the rear end in the conveyance direction D1 of the sheet P, and a previously-set range from the ends in the width direction D2. For example, it is conceivable that, in the specific region, the distance from the leading end or the rear end in the conveyance direction D1 of the sheet P is previously set in a range of 0.1 cm or greater and 3.0 cm or smaller, and the distance from each end in the width direction D2 of the sheet P is previously set in a range of 0.1 cm or greater and 3.0 cm or smaller. The use amount specifying portion 112 of the control portion 11 calculates the coverage rate or the ink amount rate in the specific region based on image data being the target of the image forming process, and specifies the ink use amount in the specific region based on the coverage rate and the ink amount rate. Further, it is also conceivable that the specific region is a region in a previously-set range from the leading end in the conveyance direction D1 of the sheet P when the sheet P is conveyed again to the image forming portion 3 by the double-sided printing mechanism 65.

<Step S92>

In step S92, the second stop control portion 115 of the control portion 11 determines whether the ink use amount specified in step S91 is higher than or equal to the previously-set sixth threshold. The sixth threshold is a value previously set in order to determine whether the attraction force by electrostatic attraction is sufficiently low. For example, the sixth threshold may be a previously-set value as an ink use amount corresponding to a range of 50% or higher and 80% or lower for the coverage rate, or a range of 50% or higher and 100% or lower for the ink amount rate. Alternatively, the second stop control portion 115 may determine whether the ink use amount is higher than or equal to the sixth threshold based on whether the coverage rate or the ink amount rate is higher than or equal to a predetermined value. When determining that the ink use amount is higher than or equal to the sixth threshold (Yes in S92), the control portion 11 shifts the process to step S93. On the other hand, when determining that the ink use amount is less than the sixth threshold (No in S92), the control portion 11 shifts the process to step S94.

<Step S93>

In step S93, the second stop control portion 115 of the control portion 11 sets "no drive" with regard to turning on/off the drive of the charging portion 8 during back surface printing in the image forming process. Accordingly, during back surface printing in the image forming process, charging by the charging portion 8 is stopped and electrostatic attraction is not performed. Thus, in the image forming apparatus 10, in a case where the attraction force by electrostatic attraction is low because the ink use amount is sufficiently large, the drive of the charging portion 8 is stopped, whereby power saving is achieved.

<Step S94>

In step S94, the first stop control portion 114 of the control portion 11 determines whether the ink use amount specified in step S91 is less than the previously-set fourth threshold. The fourth threshold is a value previously set in order to determine whether the attraction force by electrostatic attraction is sufficiently high. For example, the fourth threshold may be a previously-set value as an ink use amount corresponding to a range of 10% or higher and 50% or lower for the coverage rate, or a range of 10% or higher and 50% or lower for the ink amount rate. Alternatively, the first stop control portion 114 may determine whether the ink use amount is less than the fourth threshold in accordance with whether the coverage rate or the ink amount rate is less than a predetermined value. When determining that the ink use amount is less than the fourth threshold (Yes in S94), the control portion 11 shifts the process to step S941. On the other hand, when determining that the ink use amount is higher than or equal to the fourth threshold (No in S94), the control portion 11 shifts the process to step S95.

<Step S941>

In step S941, the first stop control portion 114 of the control portion 11 sets "no drive" with regard to turning on/off the drive of the air intake portion 7 during back surface printing in the image forming process. Accordingly, during back surface printing in the image forming process, suction of air by the air intake portion 7 is stopped, and suction attraction is not performed. Thus, in the image forming apparatus 10, in a case where the ink use amount is sufficiently small and the attraction force by electrostatic attraction is high, the drive of the air intake portion 7 is stopped, whereby power saving is achieved.

<Step S95>

In step S95, the first air intake control portion 111 of the control portion 11 determines whether the ink use amount specified in step S91 is higher than or equal to the previously-set second threshold. The second threshold is a value previously set in order to determine whether the attraction force by electrostatic attraction is low because the ink use amount is large. For example, the second threshold may be a previously-set value as an ink use amount corresponding to a range of 50% or higher and 80% or lower for the coverage rate, or a range of 50% or higher and 100% or lower for the ink amount rate. Alternatively, the first air intake control portion 111 may determine whether the ink use amount is higher than or equal to the second threshold in accordance with whether the coverage rate or the ink amount rate is higher than or equal to a predetermined value. When determining that the ink use amount is higher than or equal to the second threshold (Yes in S95), the control portion 11 shifts the process to step S951. On the other hand, when determining that the ink use amount is less than the second threshold (No in S95), the control portion 11 shifts the process to step S96.

<Step S951>

In step S951, the first air intake control portion 111 of the control portion 11 sets previously-set "high" as the suction force by the air intake portion 7 during back surface printing in the image forming process. That is, in a case where the ink use amount during front surface printing of the sheet P is large, the suction force by the air intake portion 7 is set high, whereby insufficient attraction force by electrostatic attraction due to reduced charging efficiency of the sheet P by the charging portion 8 is compensated.

<Step S96>

In step S96, the first air intake control portion 111 of the control portion 11 sets previously-set "low" which is lower than the "high" set in step S951, as the suction force by the air intake portion 7 during back surface printing in the image forming process. That is, in a case where the ink use amount during front surface printing of the sheet P is small, the charging efficiency of the sheet P by the charging portion 8 is high and the attraction force by electrostatic attraction is high. Thus, by setting the suction force by the air intake portion 7 to be low, power consumption by the air intake portion 7 is suppressed.

<Step S97>

In step S97, in accordance with the size of the sheet P and the ink use amount, the selection control portion 116 of the control portion 11 selects one or a plurality of air intake ducts from among the air intake ducts 721 to 723, as air intake ducts to be used during back surface printing of the sheet P. In the present embodiment, the selection from among the air intake ducts 721 to 723 is equivalent to selection from among the air intake fans 73 to 75. For example, the control portion 11 selects an air intake duct in the following procedure.

First, the control portion 11 selects an air intake duct present at the position of the ends in the width direction D2 of the size of the sheet P, from among the air intake ducts 721 to 723. For example, in a case where the size of the sheet P is "A3", the air intake duct 721 is selected. In a case where the size of the sheet P is "A4", the air intake duct 722 is selected. In a case where the size of the sheet P is "A5", the air intake duct 723 is selected.

Accordingly, from among the air intake ducts 721 to 723, the air intake duct present at the ends of the size of the sheet P is selected, to be used during sheet conveyance. Therefore, lifting in end portions of the sheet P, especially in corner portions, is prevented from occurring.

Then, in accordance with the ink use amount, the control portion 11 determines whether to use one or a plurality of air intake ducts present inside relative to the air intake duct selected according to the size of the sheet P, among the air intake ducts 722 to 723. For example, in a case where the air intake duct 721 has been selected in accordance with the size of the sheet P and the ink use amount is higher than or equal to a previously-set first use amount, the control portion 11 determines to use the air intake duct 722 and the air intake duct 723 along with the air intake duct 721. In a case where the air intake duct 721 has been selected in accordance with the size of the sheet P and the ink use amount is less than the first use amount and higher than or equal to a previously-set second use amount, the control portion 11 determines to use the air intake duct 722 along with the air intake duct 721. Further, in a case where the air intake duct 721 has been selected in accordance with the size of the sheet P and the ink use amount is less than the second use amount, the control portion 11 determines not to use the air intake duct 722 and the air intake duct 723.

In this manner, in a case where the ink use amount is large and the attraction force by electrostatic attraction is low, along with the air intake duct selected in accordance with the size of the sheet P, one or a plurality of air intake ducts present inside relative to the air intake duct are used. Thus, insufficient attraction force by electrostatic attraction is compensated with suction attraction by the air intake portion 7. Moreover, in a case where the ink use amount is small and the attraction force by electrostatic attraction is high, unnecessary drive of the air intake fans 73 to 75 is prevented. Therefore, power consumption by the air intake portion 7 is suppressed. It should be noted that in a case where "no drive" has been set for the air intake portion 7 in step S941, the control portion 11 may skip step S97.

<Step S10>

With reference back to FIG. 4, in step S10, the control portion 11 controls the air intake portion 7 and the charging portion 8 based on various set contents made in the conveyance control process, and starts conveyance operation of the sheet P by means of the sheet conveying portion 5. Specifically, the set contents include contents regarding turning on/off the drive of the air intake portion 7, turning on/off the drive of the charging portion 8, the air suction force by the air intake portion 7, air intake ducts to be used among the air intake ducts 721 to 723, and the like. For example, during front surface printing of the sheet P, the control portion 11 drives the air intake fan(s) 73 to 75 corresponding to the air intake duct(s) selected in step S7 from among the air intake ducts 721 to 723. Moreover, during back surface printing of the sheet P, the control portion 11 drives the air intake fan(s) 73 to 75 corresponding to the air intake duct(s) selected in step S97 from among the air intake ducts 721 to 723. It should be noted that the various set contents have been stored in the RAM or the EEPROM in the control portion 11, in the conveyance control process.

As described above, in the image forming apparatus 10, by the conveyance control process being executed by the control portion 11, the air intake portion 7 and the charging portion 8 are controlled in accordance with the size of the sheet P, the humidity, and the ink use amount, whereby lifting in the sheet P is prevented from occurring and power saving is achieved.

In the present embodiment, a case has been described in which, in step S9, settings different from those during front surface printing of the sheet P are made for back surface printing of the sheet P. However, another embodiment is also conceivable in which the double-sided printing mechanism 65 is not provided and steps S8 to S9 are omitted. Alternatively, another embodiment is also conceivable in which the double-sided printing mechanism 65 is provided, and in which the control portion 11 can previously set, for example, in initial setting of the image forming apparatus 10, whether to execute the process of step S9 in accordance with operation made onto the operation display portion 12 by the user. Further, it is also conceivable that, also during back surface printing of the sheet P, operation of the air intake portion 7 and the charging portion 8 is controlled based on the humidity, as in front surface printing of the sheet P.

In the present embodiment, a case has been described in which an air intake duct to be used in the air intake portion 7 is selected from among the air intake ducts 721 to 723, in accordance with not only the size of the sheet P but also the humidity or the ink use amount. However, another embodiment is also conceivable in which an air intake duct to be used in the air intake portion 7 is selected from among the air intake ducts 721 to 723, only in accordance with the size of the sheet P.

Further, in the present embodiment, a case has been described in which the air suction force by the air intake portion 7 is switched between two levels of "high" or "low", relative to a predetermined threshold for the humidity or the ink use amount. However, another embodiment is also conceivable in which the first air intake control portion 111 and the second air intake control portion 113 of the control portion 11 control the suction force stepwise such that the higher the humidity is, or the larger the ink use amount is, the higher the air suction force by the air intake portion 7 becomes. It is also conceivable that in accordance with the humidity or the ink use amount, the higher the humidity is or the larger the ink use amount is, the higher the charging portion 8 increases the level of voltage to be applied from the power supply device 82 to the charging member 81.

Moreover, it is also conceivable that the image forming portion 3 of the image forming apparatus 10 is an image forming portion of an electrophotographic type including a photosensitive drum, a charging portion, an exposure device, a developing device, a transfer roller, a fixing device, a toner container, and the like. In the image forming portion of an electrophotographic type, the exposure device applies laser light based on image data to the photosensitive drum charged at a predetermined potential by the charging portion, thereby to form an electrostatic latent image. Thereafter, the developing device develops the electrostatic latent image into a toner image by use of a toner supplied from the toner container. Meanwhile, each sheet P is conveyed by the sheet conveying portion 5 on the sheet conveyance path from the sheet feed cassette 1 to the photosensitive drum and the transfer roller. The photosensitive drum and the transfer roller transfer the toner image formed on the photosensitive drum onto the sheet P.

Second Embodiment

Figure 6:
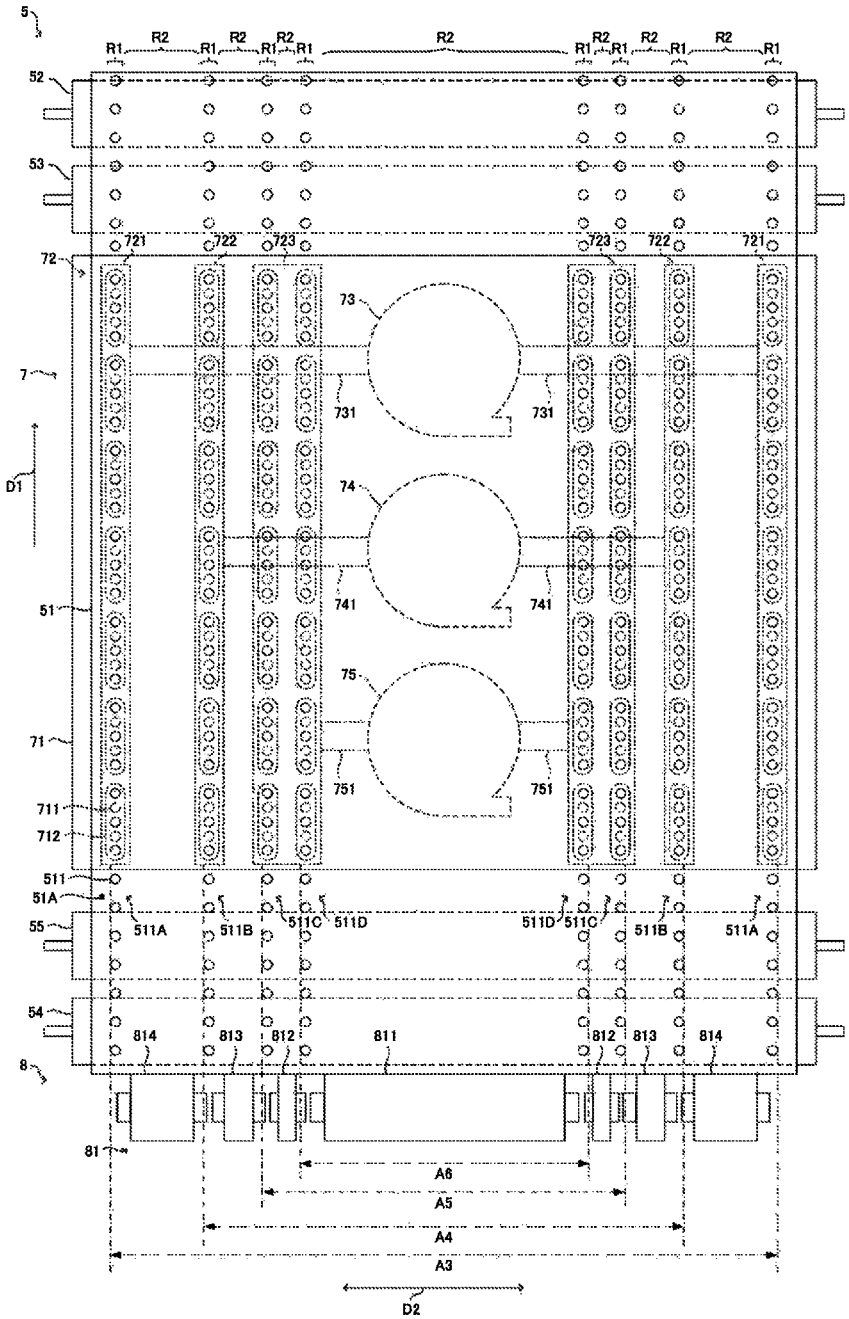
FIG. 6 shows a conveyance belt provided in an image forming apparatus according to a second embodiment of the present disclosure, viewed from above.
Figure 7:
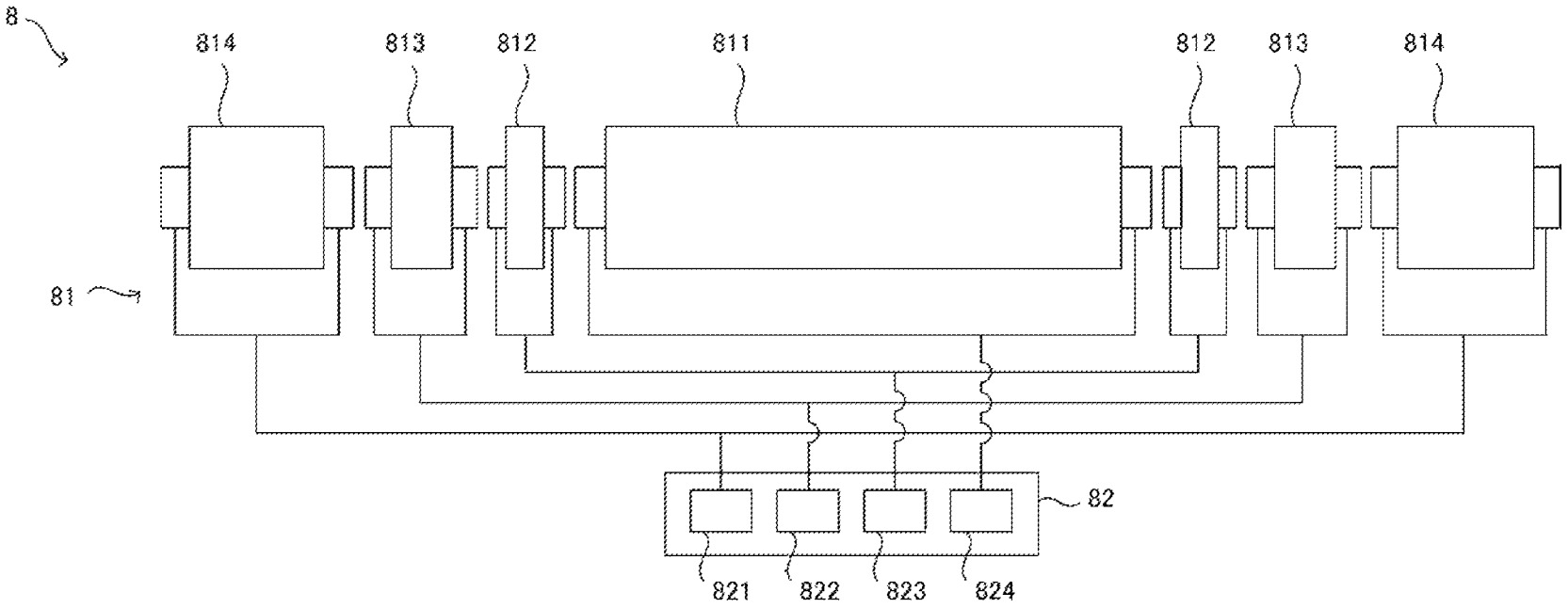
FIG. 7 shows a circuit configuration of a charging portion of the image forming apparatus according to the second embodiment of the present disclosure.

Next, a second embodiment of the present disclosure will be described. In the second embodiment, the same configurations and processes as those in the first embodiment are not described, and the difference between the second embodiment and the first embodiment will be described. FIG. 6 is a schematic diagram of the conveyance belt 51 viewed from above. FIG. 7 shows a circuit configuration of the charging portion 8.

As shown in FIG. 6, the belt openings 511 are formed in a plurality of previously-set suction attraction regions R1, of the conveyance belt 51, corresponding to ends of the sizes of a plurality of types of sheets P in the width direction D2 perpendicular to the conveyance direction D1 of each sheet P, at predetermined intervals in the conveyance direction D1. More specifically, each belt opening 511 is formed such that a corresponding end in the width direction D2 of the sheet P having the size of the sheet P corresponding to the belt opening 511 is substantially aligned with the outer edge of the belt opening 511.

The belt openings 511 are classified into a plurality of belt opening groups 511A to 511D corresponding to the sizes of the plurality of types of sheets P. The belt opening group 511A is formed along the conveyance direction D1 at the position corresponding to ends of the maximum size (for example, A3) of the sheet P usable in the image forming apparatus 10. Similarly, the belt opening group 511D corresponds to ends of the minimum size (for example, A6) of the sheet P usable in the image forming apparatus 10. The belt opening groups 511B, 511C respectively correspond to ends of the sizes (for example, A4R, A5) between the maximum size and the minimum size. It should be noted that the belt openings 511 may be arranged in a staggered manner in the conveyance belt 51.

The air intake duct 72 includes a plurality of air intake ducts 721 to 723 which are provided so as to correspond to the sizes of the plurality of types of sheets P to be conveyed by the conveyance belt 51, and which form air flow paths below the platen openings 711 in the conveyance plate 71. Specifically, the air intake duct 721 is a pair of ducts provided so as to correspond, in the width direction D2, to the suction attraction region R1 where the belt opening group 511A is formed. The air intake duct 722 is a pair of ducts provided so as to correspond, in the width direction D2, to the suction attraction region R1 where the belt opening group 511B is formed. The air intake duct 723 is a pair of ducts provided so as to correspond, in the width direction D2, to the suction attraction region R1 where the belt opening group 511C and the belt opening group 511D are formed.

Therefore, in the air intake portion 7, by switching turning on/off the drive of each of the air intake fans 73 to 75, it is possible to individually switch the turning on/off suction of air at its corresponding suction attraction region R1 corresponding to the air intake duct 721 to 723. For example, in step S7, in a case where the size of the sheet P is "A3", the air intake duct 721 is selected, and in a case where the size of the sheet P is "A4", the air intake duct 722 is selected. In a case where the size of the sheet P is "A5" or "A6", the air intake duct 723 is selected.

On the other hand, the charging member 81 of the charging portion 8 includes a plurality of charging members 811 to 814 corresponding to a plurality of electrostatic attraction regions R2 previously-set so as to avoid the suction attraction regions R1 in the conveyance belt 51. The charging members 811 to 814 are each a roller member individually rotatably supported by a bearing not shown, and are electrically separated from each other. The charging members 811 to 814 come into contact with the electrostatic attraction regions R2 corresponding to the charging members 811 to 814, respectively, thereby charging the electrostatic attraction regions R2, respectively. It should be noted that each electrostatic attraction region R2 is a region between adjacent suction attraction regions R1. Specifically, the charging member 811 is disposed so as to correspond to a center portion of the conveyance belt 51. Each of the charging members 812 to 814 is a pair of charging members arranged at both sides of the charging member 811.

As shown in FIG. 7, the power supply device 82 of the charging portion 8 includes switching portions 821 to 824 respectively connected to the charging members 811 to 814. The switching portions 821 to 824 can respectively and individually switch turning on/off supply of power to the charging members 811 to 814. In accordance with a control instruction from the control portion 11, the power supply device 82 can charge, by use of the switching portion(s) 821 to 824, electrostatic attraction region(s) R2 with one or a plurality of charging members from among the charging members 811 to 814.

Accordingly, the charging portion 8 can charge only the electrostatic attraction regions R2 avoiding the suction attraction regions R1. That is, the charging portion 8 does not apply voltage to the suction attraction regions R1 in the conveyance belt 51, and thus, the suction attraction regions R1 in the conveyance belt 51 are not charged. Thus, discharge that may occur in the belt openings 511 in a configuration using both electrostatic attraction and suction attraction to attract each sheet P to the conveyance belt 51 and convey the sheet P is prevented, and deterioration of the conveyance belt 51, the charging member 81, the driven roller 54, and the like is prevented.

Figure 8:
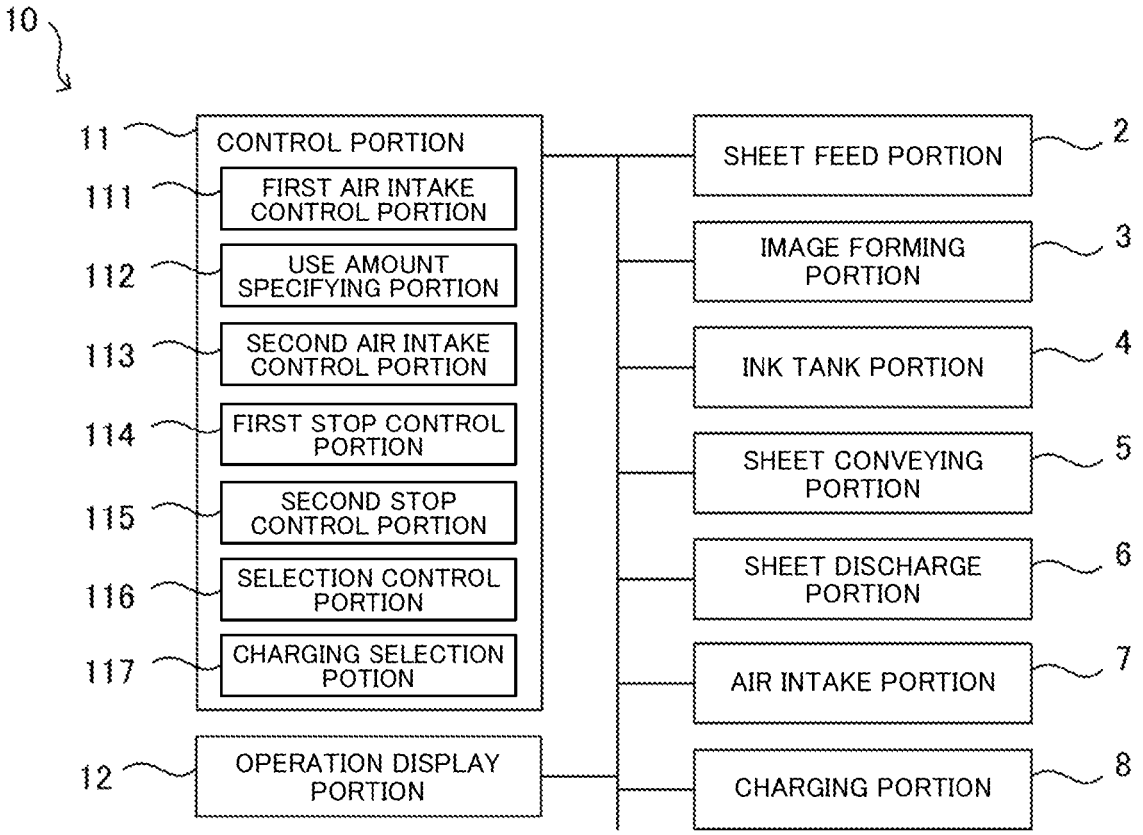
FIG. 8 is a block diagram showing a system configuration of the image forming apparatus according to the second embodiment of the present disclosure.

As shown in FIG. 8, the control portion 11 includes a charging selection potion 117. Specifically, the control portion 11 executes, by use of the CPU, the control programs stored in the ROM, thereby functioning as the charging selection potion 117. In a case where the control portion 11 is an electronic circuit such as ASIC, the charging selection potion 117 is a circuit module included in the control portion 11.

In accordance with the size of the sheet P, the charging selection potion 117 selects one or a plurality of charging members to be used in charging by the charging portion 8, from among the charging members 811 to 814.

<Step S71>

Figure 9:
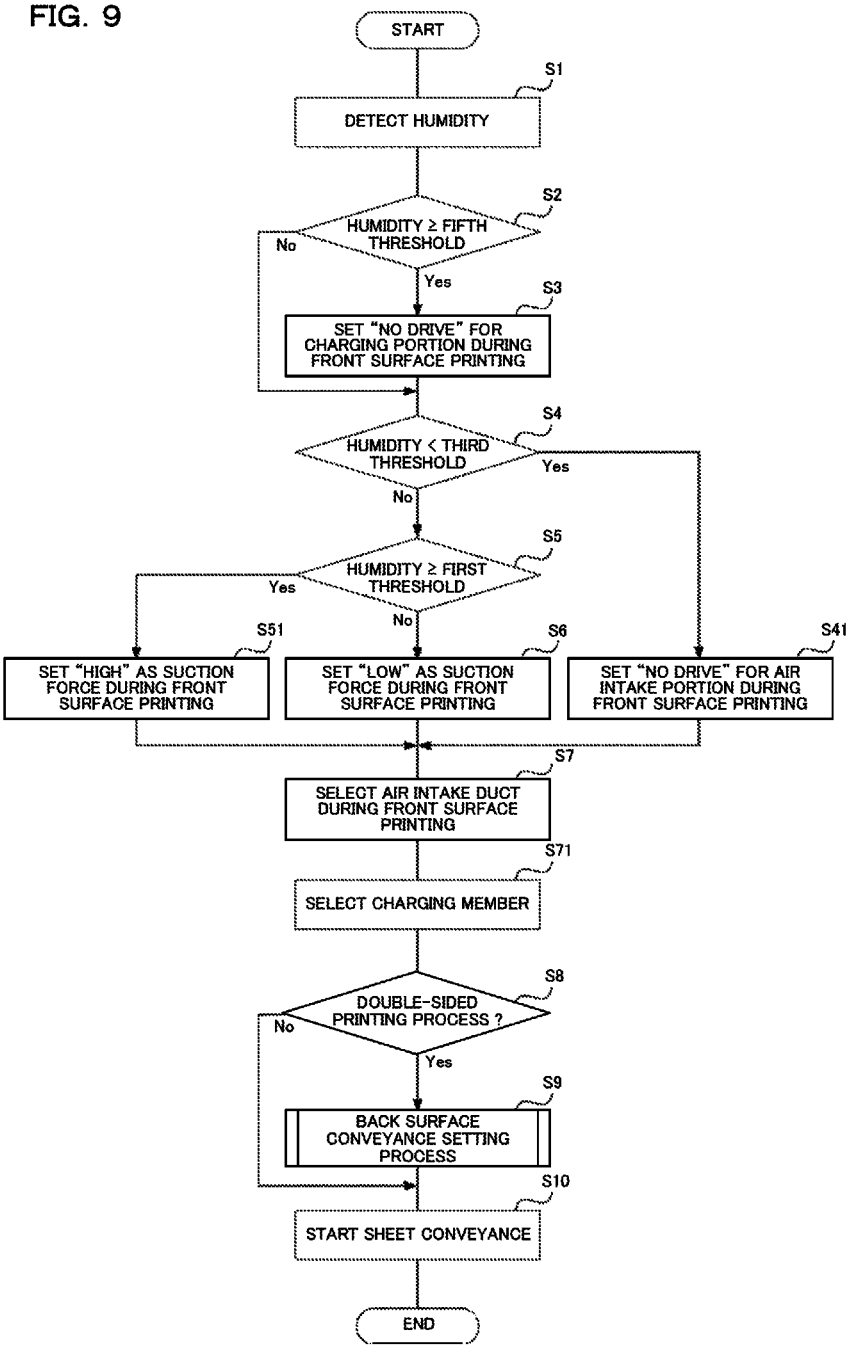
FIG. 9 is a flow chart showing a conveyance control process executed by the image forming apparatus according to the second embodiment of the present disclosure.

Then, as shown in FIG. 9, in the conveyance control process, step S71 is executed following step S7. In step S71, in accordance with the size of the sheet P, the charging selection potion 117 of the control portion 11 selects one or a plurality of charging members from among the charging members 811 to 814, as charging members to be used during front surface printing or during back surface printing of the sheet P. It should be noted that, in step S71, one or a plurality of charging members to be used during front surface printing of the sheet P may be selected, and one or a plurality of charging members to be used during back surface printing of the sheet P may be selected in the back surface conveyance setting process. In the present embodiment, the selection from among the charging members 811 to 814 is equivalent to selection from among the switching portions 821 to 824.

Specifically, the control portion 11 selects, from among the charging members 811 to 814, charging members present inside the position of the ends in the width direction D2 of the size of the sheet P. For example, in a case where the size of the sheet P is "A3", the charging members 811 to 814 are selected. In a case where the size of the sheet P is "A4", the charging members 811 to 813 are selected. In a case where the size of the sheet P is "A5", the charging members 811 and 812 are selected. In a case where the size of the sheet P is "A6", the charging member 811 is selected.

Accordingly, among the charging members 811 to 814, charging members corresponding to the size of the sheet P are selected to be used during sheet conveyance. Therefore, compared with a case where power is always supplied to the charging members 811 to 814, power saving is achieved. Alternatively, another embodiment is also conceivable in which step S71 is omitted and power is always supplied to the charging members 811 to 814. Further, in a case where "no drive" has been set for the charging portion 8 in step S3, the control portion 11 may skip step S71.

<Step S97>

On the other hand, in step S97, the control portion 11 selects, from among the air intake ducts 721 to 723, an air intake duct present at the position of the ends in the width direction D2 of the size of the sheet P. For example, in a case where the size of the sheet P is "A3", the air intake duct 721 is selected. In a case where the size of the sheet P is "A4", the air intake duct 722 is selected. In a case where the size of the sheet P is "A5" or "A6", the air intake duct 723 is selected.

<Step S10>

Then, in step S10, the control portion 11 controls the air intake portion 7 and the charging portion 8 based on various set contents made in the conveyance control process, and starts conveyance operation of the sheet P by means of the sheet conveying portion 5. Specifically, the set contents include contents regarding turning on/off the drive of the air intake portion 7, turning on/off the drive of the charging portion 8, the air suction force by the air intake portion 7, air intake ducts to be used among the air intake ducts 721 to 723, charging members to be used among the charging members 811 to 814, and the like. For example, during front surface printing or during back surface printing of the sheet P, the control portion 11 controls switching portion(s) corresponding to the charging member(s) selected in step S71 from among the switching portions 821 to 824 corresponding to the charging members 811 to 814, thereby to charge one or a plurality of the charging members 811 to 814. It should be noted that the various set contents have been stored in the RAM or the EEPROM of the control portion 11, in the conveyance control process.

Figure 10:
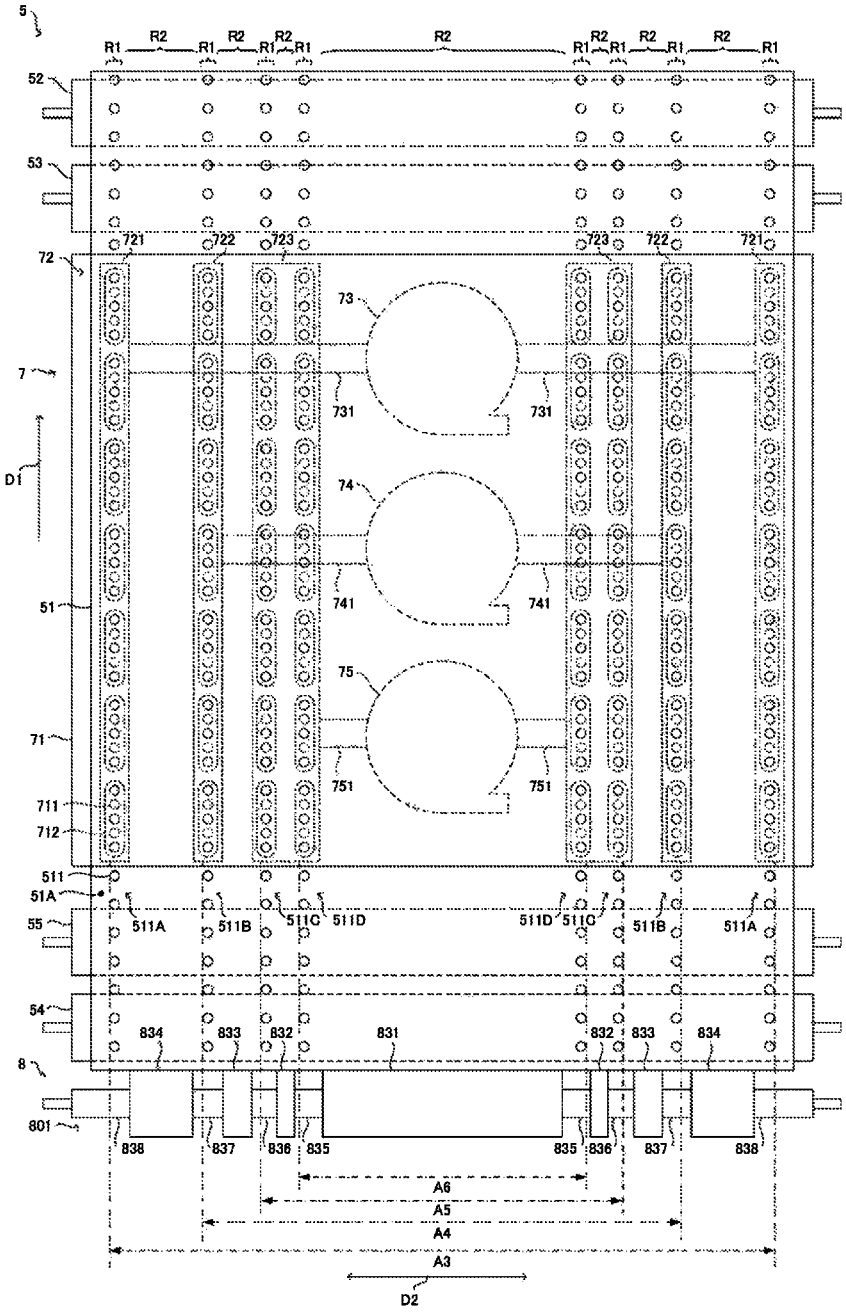
FIG. 10 shows another example of a charging portion of the image forming apparatus according to the second embodiment of the present disclosure.

In the present embodiment, a configuration has been described in which the charging portion 8 includes the plurality of charging members 811 to 814. However, another configuration is also conceivable in which, as shown in FIG. 10, the charging portion 8 includes one charging member 801 which is in contact with each of the electrostatic attraction regions R2 set so as to avoid each of the suction attraction regions R1 in the conveyance belt 51. Specifically, the charging member 801 includes contact portions 831 to 834 which are in contact with the electrostatic attraction regions R2, respectively, and recessed portions 835 to 838 for avoiding the suction attraction regions R1, respectively. In this case, the power supply device 82 can switch only turning on/off supply of power to the charging member 801, and step S71 in the conveyance control process is omitted. Even in this configuration, the charging portion 8 can charge, by use of the charging member 801, only the electrostatic attraction regions R2 avoiding the suction attraction regions R1 in the sheet placing surface 51A of the conveyance belt 51.

In the present embodiment, a case has been described in which air intake duct(s) to be used in the air intake portion 7 are selected from among the air intake ducts 721 to 723, and charging member(s) to be used in the charging portion 8 are selected from among the charging members 811 to 814, in accordance with not only the size of the sheet P but also the humidity or the ink use amount. However, another embodiment is also conceivable in which air intake duct(s) to be used in the air intake portion 7 are selected from among the air intake ducts 721 to 723, and charging member(s) to be used in the charging portion 8 are selected from among the charging members 811 to 814, in accordance with only the size of the sheet P.

Further, it is also conceivable that, in accordance with the humidity or the ink use amount, the higher the humidity is or the larger the ink use amount is, the higher the charging portion 8 increases the level of voltage to be applied from the power supply device 82 to the charging members 811 to 814.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet conveying device comprising:

a conveyance belt having a plurality of belt openings formed in a previously-set suction attraction region in end portions thereof in a width direction perpendicular to a conveyance direction of a sheet, the conveyance belt configured to convey the sheet;

a conveyance plate having a plurality of platen openings formed therein at positions corresponding to the belt openings in the width direction, the conveyance plate disposed on a back surface side of the conveyance belt;

an air intake portion configured to suction air through the belt openings and the platen openings from the back surface side of the conveyance plate; and a charging portion configured to charge a previously-set electrostatic attraction region in a center portion in the width direction of the conveyance belt so as to avoid the suction attraction regions in the conveyance belt.

2. The sheet conveying device according to claim 1, further comprising:

a humidity detecting portion configured to detect humidity; and a first air intake control portion configured to control the air intake portion such that the higher the humidity detected by the humidity detecting portion is, the higher suction force of the air becomes.

3. The sheet conveying device according to claim 2, wherein the first air intake control portion switches the suction force in accordance with whether the humidity is higher than or equal to a previously-set first threshold.

4. The sheet conveying device according to claim 1, further comprising:

a use amount specifying portion configured to specify an ink use amount to be ejected onto a front surface of the sheet by an image forming portion configured to form an image by ejecting ink in an image forming apparatus including the sheet conveying device;

a double-sided printing mechanism configured to reverse the front and back surfaces of the sheet on which an image has been formed by the image forming portion, to convey again the sheet to the image forming portion; and a second air intake control portion configured to, when the sheet is conveyed again by the double-sided printing mechanism to the image forming portion, control the air intake portion such that the larger the ink use amount specified by the use amount specifying portion is, the higher suction force of the air becomes.

5. The sheet conveying device according to claim 4, wherein the second air intake control portion switches the suction force in accordance with whether the ink use amount specified by the use amount specifying portion is higher than or equal to a previously-set second threshold.

6. The sheet conveying device according to claim 4, further comprising a first stop control portion configured to stop suction of the air by the air intake portion in a case where the humidity detected by the humidity detecting portion is less than a previously-set third threshold, or in a case where the ink use amount specified by the use amount specifying portion is less than a previously-set fourth threshold.

7. The sheet conveying device according to claim 4, further comprising a second stop control portion configured to stop charging of the conveyance belt by the charging portion in a case where the humidity detected by the humidity detecting portion is higher than or equal to a previously-set fifth threshold, or in a case where the ink use amount specified by the use amount specifying portion is higher than or equal to a previously-set sixth threshold.

8. The sheet conveying device according to claim 1, wherein the air intake portion includes a plurality of air intake ducts provided so as to correspond to sizes of sheets each conveyed by the conveyance belt, the plurality of air intake ducts forming air flow paths below the platen openings, and the sheet conveying device further comprises a selection control portion configured to select one or a plurality of the air intake ducts to be used in suction of the air by the air intake portion, in accordance with the size of each sheet.

9. The sheet conveying device according to claim 8, further comprising a humidity detecting portion configured to detect humidity, wherein the selection control portion selects one or a plurality of the air intake ducts in accordance with the size of the sheet and the humidity detected by the humidity detecting portion.

10. An image forming apparatus comprising:

the sheet conveying device according to claim 1; and an image forming portion configured to form an image on the sheet conveyed by the sheet conveying device, by ejecting water based ink.

11. A sheet conveying device comprising:

a conveyance belt having a plurality of belt openings formed in a plurality of previously-set suction attraction regions thereof corresponding to ends of sizes of a plurality of types of sheets in a width direction perpendicular to a conveyance direction of each sheet, the conveyance belt configured to convey the sheet;

a conveyance plate having a plurality of platen openings formed therein at positions corresponding to the belt openings in the width direction, the conveyance plate disposed on a back surface side of the conveyance belt;

an air intake portion configured to suction air through the belt openings and the platen openings from the back surface side of the conveyance plate; and a charging portion configured to, by use of a charging member in contact with a plurality of previously-set electrostatic attraction regions provided so as to avoid the suction attraction regions in the conveyance belt, charge the electrostatic attraction regions.

12. The sheet conveying device according to claim 11, wherein the charging member includes a plurality of charging members provided so as to correspond to the plurality of electrostatic attraction regions, the charging portion includes a switching portion capable of individually switching turning on/off supply of power to each of the charging members, and the sheet conveying device includes a charging selection potion configured to select one or a plurality of the charging members to be used in charging by the charging portion, in accordance with the size of the sheet.

13. The sheet conveying device according to claim 11, further comprising:

a humidity detecting portion configured to detect humidity; and a first air intake control portion configured to control the air intake portion such that the higher the humidity detected by the humidity detecting portion is, the higher suction force of the air becomes.

14. The sheet conveying device according to claim 11, further comprising:

a use amount specifying portion configured to specify an ink use amount to be ejected onto a front surface of the sheet by an image forming portion configured to form an image by ejecting ink in an image forming apparatus including the sheet conveying device;

a double-sided printing mechanism configured to reverse the front and back surfaces of the sheet on which an image has been formed by the image forming portion, to convey again the sheet to the image forming portion; and a second air intake control portion configured to, when the sheet is conveyed again by the double-sided printing mechanism to the image forming portion, control the air intake portion such that the larger the ink use amount specified by the use amount specifying portion is, the higher suction force of the air becomes.

15. The sheet conveying device according to claim 14, wherein the second air intake control portion switches the suction force in accordance with whether the ink use amount specified by the use amount specifying portion is higher than or equal to a previously-set second threshold.

16. The sheet conveying device according to claim 14, further comprising a first stop control portion configured to stop suction of the air by the air intake portion in a case where the humidity detected by the humidity detecting portion is less than a previously-set third threshold, or in a case where the ink use amount specified by the use amount specifying portion is less than a previously-set fourth threshold.

17. The sheet conveying device according to claim 14, further comprising a second stop control portion configured to stop charging of the conveyance belt by the charging portion in a case where the humidity detected by the humidity detecting portion is higher than or equal to a previously-set fifth threshold, or in a case where the ink use amount specified by the use amount specifying portion is higher than or equal to a previously-set sixth threshold.

18. The sheet conveying device according to claim 11, wherein the air intake portion includes a plurality of air intake ducts provided so as to correspond to the sizes of the sheets each conveyed by the conveyance belt, the plurality of air intake ducts forming air flow paths below the platen openings, and the sheet conveying device further comprises a selection control portion configured to select one or a plurality of the air intake ducts to be used in suction of the air by the air intake portion, in accordance with the size of each sheet.

19. The sheet conveying device according to claim 18, further comprising a humidity detecting portion configured to detect humidity, wherein the selection control portion selects one or a plurality of the air intake ducts in accordance with the size of the sheet and the humidity detected by the humidity detecting portion.

* * * * *